United States Patent [19]

Daboub

[11] 4,432,458

[45] Feb. 21, 1984

[54] ELECTRONIC CONTROL SYSTEM FOR MONITORING AND CONTROLLING THE MOVEMENT OF AN ENVELOPE THROUGH A MAIL SORTING MACHINE

[75] Inventor: Henry A. Daboub, Dallas, Tex.

[73] Assignee: Bell & Howell Company, Chicago, Ill.

[21] Appl. No.: 333,768

[22] Filed: Dec. 23, 1981

Related U.S. Application Data

[63] Continuation of Ser. No. 204,588, Nov. 6, 1980, abandoned.

[51] Int. Cl.[3] ..... B07C 3/06; B07C 5/36

[52] U.S. Cl. ..... 209/564; 209/584; 209/900

[58] Field of Search ..... 209/3.1, 3.2, 44.1, 209/562–566, 569, 584, 900, 583; 235/379, 474

[56] References Cited

U.S. PATENT DOCUMENTS

| | | | |
|---|---|---|---|
| 3,363,756 | 1/1968 | Dykaar et al. | 209/564 X |
| 3,420,368 | 1/1969 | Rosenberg et al. | 209/566 |
| 3,574,328 | 4/1971 | Holmes | 209/566 |
| 3,889,811 | 6/1975 | Yoshimura | 209/584 X |
| 3,904,516 | 9/1975 | Chiba et al. | 209/566 |

FOREIGN PATENT DOCUMENTS

| | | | |
|---|---|---|---|
| 477823 | 6/1975 | Australia | 209/584 |

*Primary Examiner*—Robert B. Reeves
*Assistant Examiner*—Edward M. Wacyra
*Attorney, Agent, or Firm*—Kokjer, Kircher, Bradley, Wharton, Bowman & Johnson

[57] ABSTRACT

An electronic control for a mail sorting machine having a single envelope guideway and a plurality of deflecting gates arranged in pairs. The control includes a plurality of tracking circuits interconnected in series with a circuit associated for each gate pair. A circuit receives a coded bin signal, processes it and, if it does not represent one of the associated gates, relays the signal to the next successive circuit. Upon receipt of a designation signal, a circuit transmits a clear signal to clear the designation information from the anteriorally positioned circuit irrespective of the speed of travel of envelopes through the machine to permit asynchronous movement of envelopes through the machine without regard to the number of envelopes which may be in process in the machine at any particular time. When a circuit receives a signal corresponding to the coded designation for one of its associated gates, that gate is operated to deflect the envelope into an appropriate bin.

6 Claims, 2 Drawing Figures

ELECTRONIC CONTROL SYSTEM FOR MONITORING AND CONTROLLING THE MOVEMENT OF AN ENVELOPE THROUGH A MAIL SORTING MACHINE

This application is a continuation of application Ser. No. 204,588, filed Nov. 6, 1980, now abandoned, which was a continuation of application Ser. No. 974,074, filed Dec. 28, 1978, now abandoned.

BACKGROUND AND BRIEF DESCRIPTION OF THE INVENTION

This invention relates in general to an electronic tracking system suitable for use in a mail sorting machine to monitor and control the movement of an envelope through the machine to thereby direct this envelope to its designated sort bin. In particular, the electronic tracking system of the present invention is comprised of a plurality of electronic tracking circuits which are interconnected in series. These circuits cooperate with each other to transfer a coded bin designation signal between them in synchronization with an envelope moving through the machine.

The volume of mail handled daily by large businesses, institutions and governmental entities has reached the point where new techniques and machines for automatically handling and sorting this mail more efficiently and economically must be developed. Although several machines for handling and sorting mail are presently available, there prior art machines have not proven to be satisfactory for several reasons. For example, the presently existing mail sorting machines are normally very complex in design and operation. These machines are typically comprised of an array of metal bands which form a plurality of guideways for transferring envelopes from a central sorting location to one of the machine's sort bins. In these machines, the incoming envelopes are initially separated and successively provided to a read station where the designated sort bin for each envelope is ascertained. The envelope is then introduced into the guideway corresponding to its designated bin for transfer to this bin. This type of mail sorting machine requires the use of a complex sorting mechanism for introducing an envelope into its appropriate guideway. The complex nature of the sorting mechanism tends to slow down the sorting operation performed by this type of machine, due to the complex physical action needed to introduce an envelope into the appropriate guideway. In addition, these prior art mail sorting machines are not very reliable and tend to bend, crumble, tear or otherwise damage the envelopes they handle. Another problem associated with these mail sorting machines is that they have a tendency to direct an envelope to the wrong sort bin.

The electronic tracking system of the present invention, however, may be incorporated into a mail sorting machine to provide a much simpler technique for handling mail within the machine. In particular, this electronic tracking system makes it possible to replace the above described plurality of guideways with a single guideway which is formed by a plurality of deflecting gates. These deflecting gates are arranged in pairs with each pair of gates being aligned to provide a channel through which an envelope may be conveyed.

The electronic tracking system is comprised of a plurality of individual tracking circuits which are connected in series. One of these tracking circuits is associated with each pair of deflecting gates to control the position of these gates. These tracking circuits operate in combination with strategically placed envelope sensors to monitor the movement of an envelope through the machine and to control the transfer of a coded bin designation signal between them in synchronization with the movement of the envelope to which the signal applies. In particular, each tracking circuit is provided with an associated envelope sensor which is properly positioned to alert its associated tracking circuit of an approaching envelope.

Upon receipt of an alert signal from its associated envelope sensor, the tracking circuit acquires from an anteriorly positioned portion, the coded bin designation signal presently stored therein and generates a clear signal which is provided to its anteriorly positioned tracking circuit to clear the coded bin designation signal presently stored with this circuit. The coded bin designation signal is assembled to have a location portion which is comprised of a binary coded number representative of a particular pair of sort bins and a bin digit which is an individual bit having a logic state representative of one of the bins of the designated pair.

The coded bin designation signal is transferred between tracking circuits such that the present numerical value of the location portion of the signal is transferred intact if the numerical value of this portion of the signal is below a preselected maximum number. If, on the other hand, the numerical value of the location portion of the coded designation signal is equal to the preselected maximum number, the coded bin designation signal is transferred to the next tracking circuit such that the location portion of the signal assumes a count state of zero.

Upon receipt of a coded bin designation signal, the tracking circuit immediately increments the binary coded number which comprises the location portion of the signal by a set amount and then compares the resulting binary number with a preselected maximum number to determine if they coincide. If the incremented portion of the coded bin designation signal does not coincide with the preselected maximum number, the position of each of the deflecting gates associated with this tracking circuit is unchanged thereby allowing the envelope to pass through the channel formed by these gates unimpeded. However, the incremented portion of the coded bin designation signal is equal to the preselected maximum number, the tracking circuit checks the logic state of the bin digit to determine which of the deflecting gates is to be activated. The tracking circuit then activates the solenoid corresponding to the designated deflecting gate causing this gate to be moved into the channel to divert an advancing envelope into the sort bin associated with this gate. The tracking circuit keeps this solenoid in an active condition until a clear signal is received from the posteriorly positioned tracking circuit. Since the location portion of the coded designation signal now has a numerical value equal to the preselected maximum number, the location portion of the coded bin designation signal is transferred to the posteriorly positioned tracking circuit and then increments the location portion of this signal and stores it until a subsequent envelope causes a new coded bin designation signal to be sorted in this circuit.

It is therefore an object of the present invention to provide an electronic tracking system which may be incorporated into a mail sorting machine to simplify the design and operation of the machine and the technique for directing an envelope to its designated sort bin.

Another object of the present invention is to provide an electronic tracking system which is suitable for monitoring and controlling the movement of an envelope through a mail sorting machine having a plurality of deflecting gates which are arranged in pairs to provide a single channel through which mail may be transferred to the machine's various sort bins.

A further object of the present invention is to provide an electronic tracking system of the character described which is comprised of a plurality of tracking circuits connected in series to transfer between them a coded location signal in synchronization with the movement of an envelope through the machine.

An additional object of the present invention is to provide an electronic tracking system of the character described which is capable of simultaneously controlling the position of two separate deflecting gates.

It is another object of the present invention to provide an electronic tracking system of the character described which is capable of accomodating envelopes of varying lengths without requiring any change in its internal components.

It is yet another object of the present invention to provide an electronic tracking system of the character described which may be used in mail sorting machines of differing operating speeds without requiring a change in any of the circuit's internal components.

It is an additional object of the invention to provide an electronic tracking system which is capable of reliable operation even if an envelope is improperly removed from the channel through which it is being conveyed to the sort bins.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are employed to indicate like parts in the various views.

Figure 1:
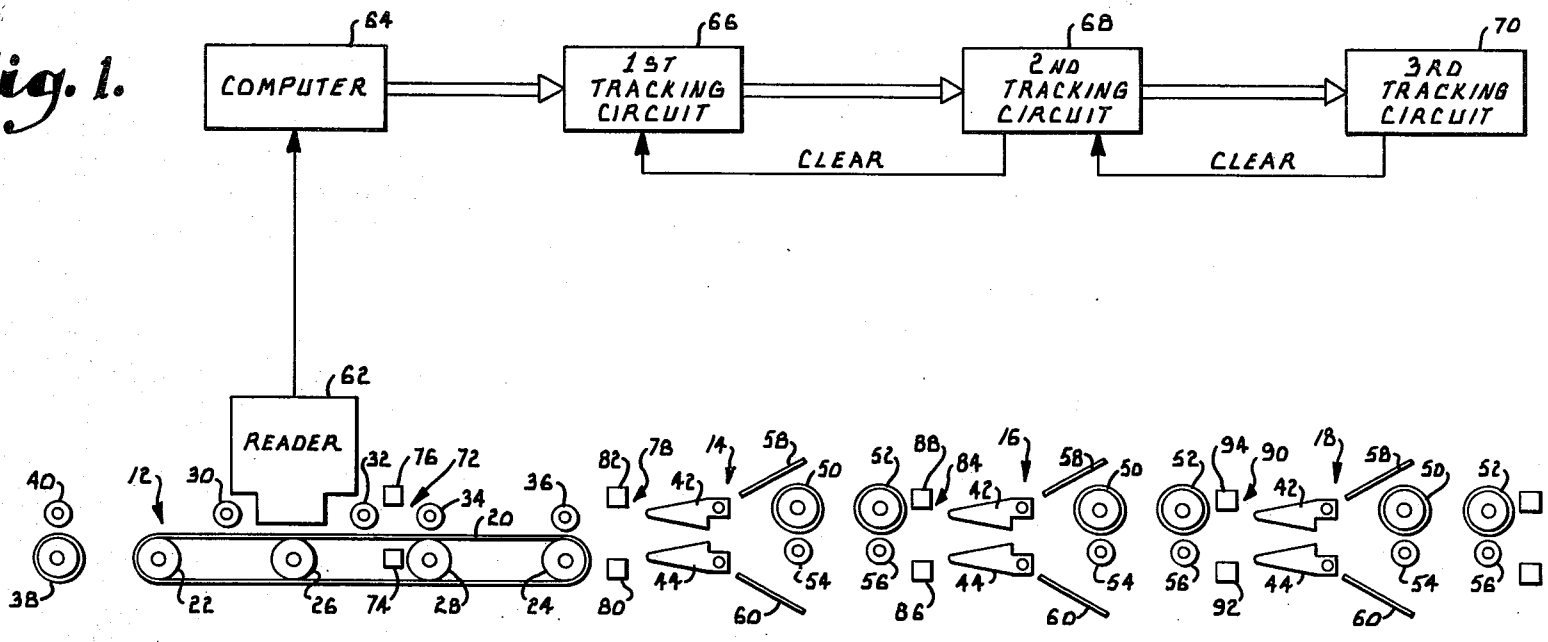
FIG. 1 is a schematic diagram showing the electronic tracking system of the present invention.

Referring now to FIG. 1, the electronic tracking system of the present invention is schematically shown in this figure. As shown in this figure, the electronic tracking system is arranged to be incorporated into a mail sorting machine having a single guideway 10 for transferring envelopes to the various sort bins of the machine. This guideway is formed by a conveying system 12 and a plurality of diverter mechanisms such as 14, 16, and 18. Conveying system 12 is principally comprised of a conveying belt 20 which is carried by a pair of pulleys 22 and 24. These pulleys are suitably driven to advance the belt in a clockwise direction as viewed in FIG. 1. A pair of idler pulleys 26 and 28 are provided to properly position the forward run of the belt. A plurality of idler rollers 30, 32, 34, and 36 are positioned adjacent to the belt to hold an envelope such as 35 against the friction surface of the conveying belt to thereby advance this envelope along the guideway from left to right as viewed in FIG. 1. The conveying system 12 also includes a drive roller 38 which cooperates with its opposing pinch roller 40 to engage and introduce an incoming envelope into the guideway of the mail sorting machine.

Each diverter mechanism is comprised of a pair of deflection gates 42 and 44 which are positioned adjacent to each other to form a channel through which an envelope may be directed. Each deflection gate is in turn coupled with an attendant solenoid (not shown) which controls the position of its associated gate. The diverter mechanism also includes a pair of drive rollers 50 and 52 which cooperate with their opposing pinch rollers 54 and 56 to drive an envelope through the guideway formed by the deflection gates. Deflecting gates 42 and 44 are provided with associated directing plates 58 and 60, respectively. Each of these directing plates is placed behind its associated deflecting gate and cooperates with its associated deflecting gate to direct an envelope into the sort bin (not shown) associated with its deflecting gate when the gate is positioned within the guideway to intercept an advancing envelope.

A reader 62 is positioned adjacent to the conveying belt to read sorting information imprinted on each envelope traveling through the guideway past this device. The sorting information is located at a similar place on each envelope and is representative of a particular sort feature. Most often, the sorting information will be representative of a zip code so that outgoing envelopes may be stored into groups with a common destination. The sorting information may, however, be representative of a particular department within a corporation or governmental entity so that incoming mail may be quickly and easily routed to its designated location.

The reader is a conventional type of device and may comprise a magnetic reading device which is capable of reading a magnetic code imprinted of each envelope or an electro-optical type of reader which is capable of using light to read a bar code imprinted on the envelope. An electro-optical reader suitable for this purpose is given and described in the U.S. patent to Harms Jr. et al., U.S. Pat. No. 3,886,328, issued May 27, 1975, which is incorporated herein by reference.

The sorting information obtained by reader 62 is provided to a computer 64 which is programmed to convert this information into a coded location signal. The coded location is assembled to have a location portion which is comprised of a binary coded number representative of a particular diverter mechanism and an additional bin digit for particularly designating one of the sort bins associated with this diverter mechanism.

The coded location signal is then provided to the electronic tracking system which is comprised of a plurality of tracking circuits such as 66, 68 and 70. These circuits are interconnected in series and each circuit is associated with a different diverter mechanism. In particular, tracking circuit 66 controls the position of deflecting gates 42 and 44 of diverter mechanism 14 and so on. Each tracking circuit is also provided with an associated envelope sensor which alerts the tracking circuit of an approaching envelope. The envelope sensor associated with the first tracking circuit 66 is generally designated by the numeral 72. This sensor is comprised of a light source 72 and a photo sensor 76 which are positioned and oriented on each side of the conveying system such that an envelope being advanced by the conveying system intercepts the beam of light which is transmitted from light source 74 to photo sensor 76. The envelope sensor associated with the second tracking circuit 68 is generally designated by the numeral 78 and is positioned just in front of diverter mechanism 14. This envelope sensor is comprised of a light source 80 and a photo sensor 82 which are positioned on opposite sides of the guideway through which the envelopes are conveyed. The light source and photo sensor are oriented such that an envelope moving through the guideway intercepts the beam of light which is transmitted from the light source to the photo sensor. Finally, the envelope sensor associated with the third tracking circuit 70 is generally designated by the numeral 84 and is positioned just in front of diverter mechanism 16. Envelope sensor 84 is likewise comprised of a light source 86 and a photo sensor 88 which are positioned on opposite sides of the guideway such that an envelope moving through the guideway will intercept the beam of light transmitted between these two elements. An additional envelope sensor 90 which is comprised of a light source 92 and a photo sensor 94 is associated with a fourth tracking circuit which is not shown in this figure.

As an envelope enters the guideway, the pinch wheel assembly comprised of drive roller 38 and pinch roller 40 engages the flat side surface of this envelope to direct the envelope to the friction surface of conveying belt 20. The conveying belt operates in combination with idler rollers 30, 32, 34, and 36 to convey the envelope down the guideway past reader 62. As the envelope moves past the reader, the sorting information imprinted on the envelope is read by the reader and transferred to the computer 64 where this information is decoded and processed to produce a coded bin designation which is representative of the sort bin which this envelope is to be deposited. As mentioned above, the coded bin designation signal is assembled to have a location portion which is comprised of a binary coded number indicative of a particular diverter mechanism and a bin digit which is a single logic bit having a logic state representative of one of the deflecting gates associated with the designated diverter mechanism. The binary coded number which comprises the location portion of the coded bin designation signal has a numerical value which is a preselected number of counts away from a set maximum number wherein the preselected number of counts corresponds to the position of the designated diverter mechanism. In other words, a difference of one count indicates that the envelope is to be diverted by one of the deflecting gates at the machine's first diverter mechanism such as 14, while a difference of two counts indicates that the envelope is to be diverted by one of the deflecting gates at the machine's second diverter mechanism such as 16. A difference of three counts, on the other hand, designates the third diverter mechanism 18 and so on.

For the purpose of explanation, it will be assumed that an envelope 35 having sorting information representative of the sort bin associated with deflecting gate 42 of diverter mechanism 16 has just passed reader 62. The computer responds to this sorting information by generating a coded bin designation signal having a location portion which is two counts below the preselected maximum value and a bin digit having a logic state which is representative of deflecting gate 42.

As envelope 35 passes between the light source 74 and the photo sensor 76, an alert signal is provided to the first tracking circuit 66. The first tracking circuit responds to this alert signal by accepting the coded bin designation signal generated by computer 64. Upon receipt of the coded bin designation signal, the first cracking circuit increments the binary coded number which comprises the location portion of the coded bin designation signal one count. Thereafter, the incremented number is compared with the preselected maximum number to determine if they coincide. Since the coded bin designation signal corresponding to envelope 35 is representative of diverter mechanism 16, the numerical value of the location portion of this signal is still one count below the preselected maximum number and, as a result, does not coincide with the preselected maximum number. Since the incremented number which comprises the location portion of the coded bin designation signal does not coincide with the maximum number, the position of both of the deflecting gates associated with this tracking circuit remains unchanged and the coded bin designation signal is stored within this tracking circuit until a clear signal is provided to this circuit from the second tracking circuit 68. It should be noted that the numerical value of the location portion of this designation signal has been permanently changed from its previous value to its incremented value and is stored within the first tracking circuit in this form.

As envelope 35 passes between the elements of envelope sensor 78, photo sensor 82 generates an alert signal which is provided to the second tracking circuit 68. Upon receipt of this alert signal, the second tracking circuit accepts the coded bin designation signal presently stored in the first tracking circuit and transmits a clear signal to the first tracking circuit. The first tracking circuit responds to this clear signal by clearing the coded bin designation signal presently stored in this circuit.

The second tracking circuit then increments the binary coded number which comprises the location portion of the coded bin designation signal one count and compares the incremented number with the preselected maximum number to determine if they coincide. Since the location portion of the coded bin designation signal was originally two counts below the preselected maximum number, these two numbers now coincide with each other. Coincidence between the number which comprises the location portion of the coded bin designation signal and the preselected maximum number causes the second tracking circuit to activate the solenoid corresponding to the deflecting gate of the diverter mechanism which is designated by the bin digit of the coded bin designation signal. In this case, the bin digit is representative of deflecting gate 42 thereby causing the solenoid associated with this gate to be activated. Activation of this solenoid causes deflecting gate 42 to move into the guideway formed by the deflecting gates of the diverter mechanism. In this position, the deflecting gate interrupts the normal movement of an envelope through the guideway and directs the envelope into the port bin associated with this gate.

As envelope 35 moves between the elements of envelope sensor 84, photosensor 88 provides an alert signal to the third tracking circuit 70. In response to this alert signal, the third tracking circuit generates a clear signal which is provided to the second tracking circuit and accepts the coded bin designation signal from the second tracking circuit. The numerical value of the location portion of the coded bin designation signal thus received has been transferred as a zero. The location portion of this signal is then incremented and compared with the preselected maximum number. Since the numerical value of the location portion of the signal was transferred to this circuit as a zero, the incremented number does not coincide with the preselected maximum number. The coded bin designation signal is stored in the third tracking circuit until a subsequent envelope causes a new coded bin designation signal to be stored in this circuit.

This second tracking circuit responds to a clear signal from the third tracking circuit by causing the stored designation signal to be cleared from this circuit. As the designation code is cleared, the activated solenoid is deactivated causing its associated deflecting gate to return to its normal position.

In summary, each tracking circuit operates in combination with an envelope sensor which is positioned in front of the diverter mechanism preceeding the diverter mechanism associated with this tracking circuit. Upon receipt of an alert signal from its attendant envelope sensor, a tracking circuit accepts the coded bin designation signal stored within the anteriorally positioned tracking circuit. The tracking circuit then increments the location portion of the signal, stores the incremented portion of the signal, and compares the incremented portion of the signal with a preselected maximum number to determine if they coincide. If the incremented portion of the designation signal does not coincide with the preselected number, the envelope associated with this signal is allowed to pass through the channel formed by the diverter mechanism's attendant deflecting gates unimpeded. As the envelope passes between the components of the envelope sensor positioned immediately in front of the tracking circuit's associated diverter mechanism, a load signal is transmitted from this sensor to the tracking circuit posteriorally positioned with respect to this tracking circuit. Upon receipt of this alert signal, the posteriorally positioned tracking circuit accepts and stores the coded bin designation signal in its incremented form (the location portion is transformed unchanged if it is not equal to the preselected maximum number and as a zero if it is equal to this number) and provides a clear signal to the preceding tracking circuit to clear the coded bin designation signal stored therein.

Coincidence between the incremented portion of the designation signal and the preselected count state, on the other hand, causes the tracking circuit to activate the solenoid associated with the deflecting gate designated by the bin digit of the coded designation signal. This solenoid remains activated until a clear signal is received by this circuit from its posteriorly positioned tracking circuit. Since the posteriorly positioned tracking circuit generates a clear signal in response to an envelope passing between the elements of the envelope sensor positioned immediately in front of the activated deflecting gate, the activated deflecting gate begins to close before the envelope reaches this gate.

Even though the activated deflecting gate begins to close before the envelope actually reaches this gate, the time required to close the gate allows for the entire envelope to pass through the gate before it completely closes or for enough of the envelope to pass through the gate that the side surface of the envelope holds the gate open enough to allow for the rest of the envelope to pass through the gate. In this way, the electronic tracking circuit of the present invention is capable of accomodating envelopes of varying lengths without changing any of its internal components. In addition, the operation of each deflecting gate is controlled by strategically placed envelope sensors which accurately coordinate the operation of these gates with the movement of an envelope through the mail sorting machine. As a result, the tracking circuit does not have to employ a timing circuit for regulating activation and deactivation of its associated solenoids. In addition, the transfer of the designation code from one tracking circuit to another is precisely synchronized with the movement of the envelope through the machine since a transfer from one circuit to another is made only upon receipt of an alert signal from a designated envelope sensor which accurately monitors the movement of the envelope through the guideway of the machine. It should be pointed out at this juncture, however, that this synchronization is between the movement of the envelopes themselves and the transfer of the information associated therewith whatever that movement may actually be. The movement of the envelopes may actually be asynchronous in that it is unnecessary to utilize means for keeping track of each envelope as it moves through the system and to insure that such movement remains synchronized with the remainder of the system. If an envelope were to be removed from the stream, for example, its destination information simply goes away and does not cause a halt of the entire system.

Figure 2:
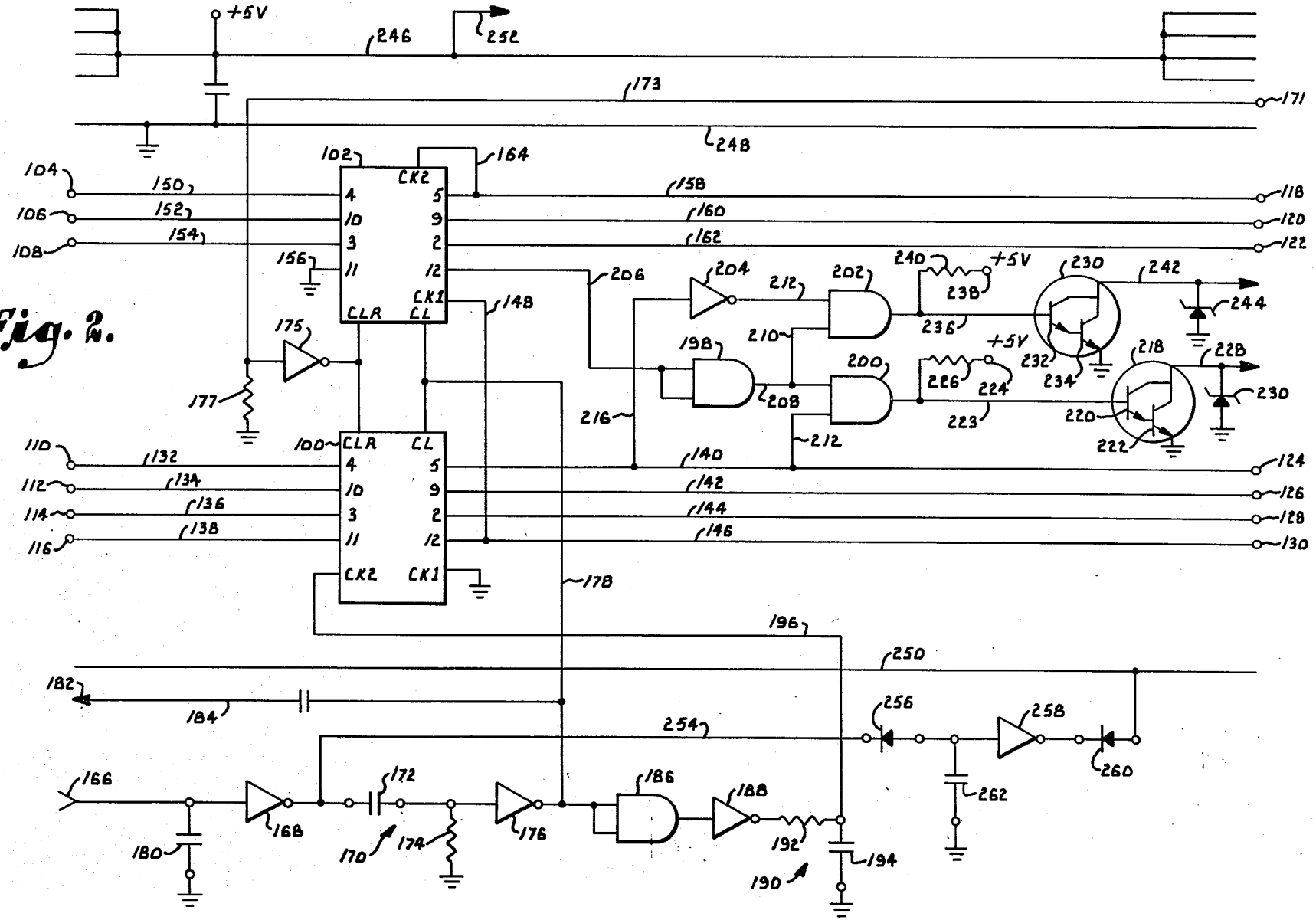
FIG. 2 is a detailed schematic diagram of one of the tracking circuits which are interconnected to form the electronic tracking system of the present invention.

Reference is now made to FIG. 2 wherein a more detailed schematic diagram of the tracking circuit is shown. The heart of the tracking circuit is a pair of programmable digital counting circuits 100 and 102. Each of these counting circuits is actually comprised of two separate counts having distinct inputs, outputs and clock terminals. The first counter incorporated into each of these circuits is a one bit counter which utilizes input pin 4 output pin 5 and the clock input identified by the designation CK1. Input pin 4 is operable to preset the count state of the first counter while output pin 5 is operable to provide an output signal representative of the preset count state of the counter. In addition, the CK1 input is operable to increment the count state of the first counter in response to a clock signal provided to this input pin. The second counter which is incorporated into counting circuits 100 and 102 is a three bit counter which utilizes input pins 10, 3 and 11, to preset the count state of this counter with input pin 10 being the least significant bit and input pin 11 being the most significant bit, output pins 9, 2 and 11 to provide an output signal representative of the present count state of the counter, and a clock input CK2 to increment the count state of the counter. Each of the counting circuits is also equipped with a single clear input which is identified by the designation CLR and a load input which is identified by the designation CL. These counting circuits respond to the application of a load signal to their CL inputs by causing the binary numbers present at input pin 4 to be loaded in the first counter and the binary number present at input pins 10, 3 and 11 to be loaded into the second counter. The application of a clear signal to the CLR input of either of these two counting circuits cause both of the circuit's counters to be cleared thereby returning both of these to a count state of zero.

The tracking circuit is provided with a plurality of input terminals 104, 106, 108, 110, 112, 114, and 116 for receiving a coded bin designation signal from its anteriorly positioned tracking circuit and a plurality of output terminals 118, 120, 122, 124, 126, 128, and 130 for providing the coded bin designation signal to its posteriorly positioned tracking circuit. Input pins 4, 10, 3 and 11 of counting circuit 100 is electrically coupled with input terminals 110, 112, 114 and 116 by means of conductor lines 132, 134, 136 and 138, respectively. This circuit's output pins 5, 9, 2 and 12 are in turn coupled with output terminals 124, 126, 128, and 130 by means of conductor lines 140, 142, 144 and 146, respectively. Output pin 12 of counting circuit 100 is also coupled with the CK1 input of counting circuit 102 by means of a conductor line 148. Input pins 4, 10 and 3 of counting circuit 102, on the other hand, are electrically coupled with input terminals 104, 106 and 108 by means of conductor lines 150, 152 and 154. Input pin 11 of this circuit is electrically coupled with systems ground by means of a conductor line 156. Output pins 5, 9 and 2 are in turn electrically coupled with output terminals 118, 120 and 122 by means of conductor lines 158, 160 and 162, respectively. In addition, output pin 5 is electrically coupled with the CK2 input pin of counting circuit 102 by means of a conductor line 164. By electrically coupling output pin 12 of counting circuit 100 with input pin CK1 of counting circuit 102 and output pin 5 of counting circuit 102 with input pin CK2 of counting circuit 102, the second counter of counting circuit 100 cooperates with the first and second counters of counting circuit 102 to form a single counting circuit having a maximum count state of 128.

Each tracking circuit is also provided with an alert signal input terminal 166 which is electrically coupled with the circuit's associated envelope sensor. The alert signal input terminal is in turn electrically coupled with the load input pins of counting circuits 100 and 102 by means of an inverter 168, an RC filter 170 (capable of generating a pulse at the leading edge of the envelope transferring the designation signal) which is comprised of capacitor 172 and resistor 174, a second inverter 176 and a conductor line 178. The alert signal input terminal 166 is also coupled with system ground by means of a capacitor 180 (a noise filter). The output of logic gate 176 is also coupled with a clear output terminal 182 by means of conductor line 178 and another conductor line 184. The clear output terminal is in turn electrically coupled with the tracking circuit's anteriorly positioned tracking circuit to provide a clear signal to the circuit. The output of logic gate 176 is also coupled with the CK2 input pin of counting circuit 100 by means of an AND gate 186, and inverter 188, an RC filter 190 (creating a delayed pulse for incrementing the data just transferred) comprised of resistor 192 and a capacitor 194, and a conductor line 196.

A clear input terminal 171 is provided to couple each tracking circuit with the clear output terminal of the posteriorly positioned tracking circuit to receive a clear signal from this circuit. The clear input terminal is electrically coupled with the clear input of counting circuits 100 and 102 by means of a conductor line 173, and an inverter 175. This input is also coupled with system ground by means of a resistor 177.

Activation of the tracking circuits associated solenoids is controlled by a plurality of logic gates 198, 200, 202 and 204. As shown in this figure, the input of logic gate 198 is electrically coupled with output pin 12 of counting circuit 102 by means of a conductor line 206. The output of logic gate 198 is electrically coupled with one input of logic gate 200 by means of a conductor line 208 and with one input of logic gate 202 by means of conductor lines 208 and 210. The other input to logic gate 200 is derived from output pin 5 of counting circuit 100 and this input is electrically coupled with output pin 5 by means of conductor lines 140 and 212. The other input to logic gate 202 is derived from the output of inverter 204 which is electrically coupled with this input by means of conductor line 214. The input of inverter 204, on the other hand, is electrically coupled with output pin 5 of counting circuit 100 by means of a conductor line 216.

The output of logic gate 200 is electrically coupled with a composite amplifier 218 which is comprised of a pair of transistors 220 and 222 which are connected in a darlington configuration by means of a conductor line 223. A power input 224 and resistor 226 are provided to properly bias this amplifier. The output of this amplifier is in turn electrically coupled with its associated solenoid by means of a conductor line 228. A Zener diode 230 is electrically coupled between conductor line 228 and system ground to act as a high voltage protection means.

The output of logic gate 202 is similarly coupled with a composite amplifier 230 which is comprised of a pair of transistors 232 and 234 which are connected in a darlington configuration, by means of a conductor line 236. A power input 238 is also coupled with the input of amplifier 230 by means of a resistor 240 (not needed in many applications) to properly bias the transistors of this amplifier. The output of amplifier 230 is electrically coupled with its associated solenoid by means of a conductor line 242. A Zener diode 244 is electrically coupled between conductor line 242 and system ground to act as a high voltage protection means.

In operation, the logic state of the signal provided to the alert input terminal 166 goes low as the leading edge of an envelope intercepts the envelope sensor associated with this tracking circuit. In outer 168, filter 170 and inverter 176 responds to this change in the state of the logic signal provided to this input terminal by generating a square pulse at the output of logic gate 176. The square thus generated is simultaneously provided to the load input of counting circuits 100 and 102 and to the clear output terminal 182. Application of this pulse to the load inputs of counting circuits 100 and 102 causes these circuits to load the binary digits present at their input pins 4, 10, 3 and 11. Since the input terminals 104, 106, 108, 110, 112, 114 and 116 which correspond with the input pins of counting circuits 100 and 102 are electrically coupled with their corresponding output pins on the anteriorly positioned tracking circuit, application of a pulse to the load input of counting circuits 100 and 102 causes the coded bin designation signal present at the output terminals of the anteriorly positional tracking circuit to be stored in these two counting circuits. The coded designation signal is assembled such that the bin digit is provided to input pin 4 of counter 100 and such that the binary coded number which comprises the location portion of the coded designation signal is provided to input pins 10, 3 and 11 of counting circuit 100 and to input pins 4, 10, 3 of counting circuit 102 with input pin 10 of counting circuit 100 representing the least significant bit and input pin 3 of counting circuit 102 representating the most significant bit.

The square pulse provided at output terminal 182 is sent to the posteriorly positioned tracking circuit where it acts as a clear signal. This circuit responds to this signal by clearing the coded bin designation signal presently stored there in.

After a set time delay induced by logic gates 186, inverter 188 and filter 190, the pulse produced at the output of logic gate 176 in response to a change in the logic state of the signal provided to the alert input terminal provided to the CK2 input of counting circuit 100 causing the count state of the counter found by the second counter of counting circuit 100, the first counter of counting circuit 102 and the second counter of counting circuit 102 to be incremented one count state. By electrically coupling output pin 12 of counting circuit 100 with the CK1 input of counting circuit 102, the output of this pin serves the clock for the first counter of counting circuit 102. The output of the first counter of counting circuit 102 is in turn electrically coupled with the CK2 input of counting circuit 102 so that this output acts as the clock for the second counter of counting circuit 102. In this way, the second counter of counting circuit 100, the first counter of counting circuit 102 and the second counter of counting circuit 102 are connected in series to provide a single counting circuit having a maximum count state of 64 and a single clock input at the CK2 input of counting circuit 100. Since the first counter of counting circuit 100 is used to transmit the bin digit, it is imperative that this digit not be changed as it moves through the system. As a result, the CK1 input of counting circuit 100 is electrically coupled with ground.

Counting circuits are capable of providing at output pins 5, 9, 2 and 12 a coded binary number representative of the present count state of each counting circuit. As shown in FIG. 2, output pins 5, 9, 2 and 12 are respectively coupled with output terminals 124, 126, 128 and 130 by means of conductor lines 140, 142, 144 and 146 while output pins 5, 9 and 2 of counting circuit 102 are respectively coupled with output terminals 118, 120 and 122 by means of conductor lines 158, 160 and 162. As a result, output terminal 124 provides a logic signal representative of the bin digit of the coded bin designation signal presently stored in this tracking circuit while output terminals 126, 128, 130, 118, 120 and 122 provide a binary coded number equal to the location position of the coded bin designation signal presently stored in this tracking circuit. Each of these output terminals is approximately coupled with its corresponding input on the posteriorly positioned tracking circuit to thereby transfer the coded bin designation signal between these circuits.

It should be noted at this time that output pin 12 of counting circuit 102 is not coupled with an output terminal. As a result, a logic signal generated at this output pin is not transferred to the posteriorly located tracking circuit along with the rest of the signals representative of the location portion of the coded bin designation signal. When the counting circuit comprised of the second counter of counting circuit 100, the first counter of counting circuit 102 and the second counter of counting circuit 102 reaches its maximum count state, only output pin 12 of counting circuit 102 is in an active condition. Since the output signal produced at this output pin is not transferred to the posteriorly positioned tracking circuit, this circuit receives a coded bin designation signal having a location position comprised of the binary coded number representative of zero.

When the single counting circuit formed by the second counter of counting circuit 100, the first counter of counting circuit 102 and the second counter of counting circuit 102 obtains the preselected count state of 64, a positive logic signal is produced at output pin 12 of counting circuit 102. This positive logic signal causes AND gate 198 to be enabled thereby providing a positive logic signal to one input of AND gates 200 and 202. The other input to logic gates 200 and 202 is derived from output pin 5 of counting circuit 100 with the logic state of the signal provided to each of these gates being of an opposite value. In particular, logic gate 200 is enabled if output pin 5 is at a positive logic level while logic gate 202 is enabled if output pin 5 is at a negative logic level. In this way, logic gates 200 and 202 operate to control activation of one of the solenoids associated with this circuit in accordance with the logic level of the bin digit of the coded bin designation signal. The positive signal produced at the enabled logic gate is then amplified in its associated amplifier 218 or 230 before being used to activate its corresponding solenoid.

Receipt of a clear signal at the clear input 171 causes counting circuits 100 and 102 to be cleared, thereby returning both of these counting circuits to a count state of zero. As these counting circuits are cleared, the positive logic signal present at output pin 12 of counting circuit 102 is terminated thereby causing logic gate 198 to be inhibited and the activated solenoid to be deactivated.

The jam detect line is common to each tracking circuit in the system and is used to monitor the movement of envelopes through the machines to provide an indication whenever an envelope becomes jammed with the machine. As the logic state of the signal provided to the alert input goes low 166, diode 256 becomes backed biased causing the positive charge on capacitor 262 to build up at the input to inverter 258. As the input to this inverter increases, its output is correspondingly decreased. When the output of the inverter drops below a cut-off value for diode 260, the jam detect line 250 is pulled low thereby indicating to the machine control circuitry that an envelope has become jammed within the machine's guide-way.

From the foregoing, it will be seen that this invention is one well adapted to attain all of the ends and objects here and above said forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein saidforth of shown in the accompanying drawings is to be interpreted as illustrated and not in any limiting sense.

Having thus described the invention, I claim:

1. In a mail sorting machine having a plurality of deflecting gates which are arranged in pairs to provide a single guideway through which envelopes may be asynchronously conveyed, each deflecting gate having a normal position in which an envelope is allowed to pass through said guideway unimpeded and a deflect position in which an envelope is deflected out of said guideway, the improvement therein of a tracking circuit associated with each pair of deflecting gates and interconnected in series with the remaining tracking circuits, each tracking circuit serving to control the position of the gates, each successive tracking circuit comprising:

sensing means for generating an alert signal in response to an approaching envelope;

means for accepting from a preceding tracking circuit an encoded designation signal in response to an alert signal, said designation signal being arranged to have a location portion which is encoded to represent a particular numerical value and an encoded gate designating portion;

each tracking circuit for a succeeding pair of gates including means for generating and transmitting a clear signal to the tracking circuit of the immediately preceding pair of gates to clear the designation signal therefrom upon the acceptance of said encoded designation signal by said tracking circuit for a succeeding pair of gates and irrespective of the elapsed time of movement of an envelope between adjacent pairs of gates as sensed by successive tracking circuits;

means for changing the numerical value of said location portion of said designation signal by a set numerical quantity to thereby produce an updated designation signal;

means for comparing the numerical value represented by the location portion of the new designation signal with a preselected numerical value; and means for examining the gate designating portion of said new designation signal if the numerical value represented by the location portion of the updated designation signal coincides with said preselected numerical value, said examining means also being operable to cause the deflecting gate designated by the gate designating portion of said updated designation signal to be placed in a deflect position.

2. The tracking circuit as in claim 1 including means for returning said one deflecting gate to its normal position upon receipt of said clear signal from the posteriorly positioned tracking circuit.

3. The tracking circuit as in claim 1 wherein said sensing means is comprised of a light source and a photocell which are positioned on opposite sides of said guideway so that said photocell is operable to generate an alert signal so long as an envelope is positioned within the guideway between said light source and said photocell.

4. The tracking circuit as in claim 3 including means for monitoring the duration of said alert signal to determine if an envelope has become stuck in said guideway between said light source and said photocell.

5. A method for controlling the position of deflecting gates of a mail sorting machine having a single guideway through which envelopes may be asynchronously conveyed and a plurality of said deflecting gates positioned to said guideway in spaced apart relationship from each other, each of said deflecting gates having a normal position in which an envelope is allowed to move past the deflecting gate unimpeded and a deflecting position in which an envelope is deflected out of said guideway, said method comprising the steps of:

generating an alert signal as an envelope approaches each deflecting gate, accepting an encoded designation signal in response to the alert signal, comparing said designation signal with a preselected code corresponding to the gate approached by the envelope, generating and transmitting a clear signal in an upstream direction to clear the designation signal corresponding to the immediately upstream gate irrespective of whether or not said designation signal coincides with said preselected code and irrespective of the rate of movement of envelopes through the machine, moving the deflecting gate approached by the envelope to a deflect position if said designation signal coincides with said preselected code, and causing the gate which is in the deflect position to return to its normal position upon receipt of a clear signal transmitted from a location immediately downstream from the gate which is in the deflect position.

6. The method as in claim 5 including the steps of monitoring the duration of the alert signal to determine if an envelope has become jammed within said guideway.

* * * * *